US007040042B2

(12) United States Patent
Light

(10) Patent No.: US 7,040,042 B2
(45) Date of Patent: May 9, 2006

(54) SKI BOOT

(76) Inventor: J. Thomas Light, 94 White Hollow Rd., Lakeville, CT (US) 06039

( * ) Notice: Subject to any disclaimer, the term of this patent is extended or adjusted under 35 U.S.C. 154(b) by 72 days.

(21) Appl. No.: 10/779,256

(22) Filed: Feb. 13, 2004

(65) Prior Publication Data

US 2005/0178028 A1 Aug. 18, 2005

(51) Int. Cl.
*A43B 5/04* (2006.01)

(52) U.S. Cl. ..... 36/117.1; 36/50.5; 36/117.6

(58) Field of Classification Search ..... 36/117.1, 36/117.8, 117.9, 118.2–118.4, 119.1, 115
See application file for complete search history.

(56) References Cited

U.S. PATENT DOCUMENTS

| | | | | |
|---|---|---|---|---|
| 2,531,763 | A | 11/1950 | Andre | |
| 3,067,531 | A | 12/1962 | Scott et al. | |
| 3,237,319 | A | 3/1966 | Hanson | |
| 3,239,952 | A | 3/1966 | Lange et al. | |
| 3,419,974 | A | 1/1969 | Lange | |
| 3,521,385 | A | 7/1970 | Dalebout | |
| 4,265,034 | A | 5/1981 | Salomon | |
| 5,142,798 | A | 9/1992 | Kaufman et al. | |
| 5,189,815 | A | 3/1993 | Pozzobon et al. | |
| 5,295,316 | A * | 3/1994 | Bergamin | 36/118.9 |
| 5,313,720 | A * | 5/1994 | De Bortoli et al. | 36/117.8 |
| 5,323,548 | A | 6/1994 | Vogel | |
| 5,572,806 | A | 11/1996 | Osawa | |
| 5,640,787 | A | 6/1997 | Spademan | |
| 5,775,009 | A * | 7/1998 | Marega et al. | 36/117.5 |
| 5,787,611 | A | 8/1998 | Bonaventure | |
| 5,806,211 | A * | 9/1998 | Pozzobon | 36/115 |
| 5,826,354 | A * | 10/1998 | Garbujo | 36/117.1 |
| 5,921,006 | A | 7/1999 | Vargas, III | |
| 5,992,872 | A | 11/1999 | Proctor | |
| 6,021,589 | A * | 2/2000 | Cagliari et al. | 36/117.1 |
| 6,226,898 | B1 * | 5/2001 | Trimble et al. | 36/118.2 |
| 6,336,279 | B1 | 1/2002 | Orso | |
| 6,402,183 | B1 | 6/2002 | Marmonier et al. | |
| 6,405,457 | B1 * | 6/2002 | Basso et al. | 36/89 |
| 6,446,363 | B1 | 9/2002 | Artus | |
| 6,474,004 | B1 | 11/2002 | Collavo | |
| 2002/0007570 | A1 * | 1/2002 | Girard | 36/88 |

OTHER PUBLICATIONS

International Organization for Standardization; International Standard ISO 5355:1997(E), "Alpine Ski-Boots—Safety Requirements and Test Methods"; Third Edition Nov. 17, 1997; International Organization for Standardization; Geneva, Switzerland.

* cited by examiner

*Primary Examiner*—Jila M. Mohandesi
(74) *Attorney, Agent, or Firm*—McCarter & English, LLP

(57) ABSTRACT

An alpine ski boot is provided that consists of a rigid sole and a shell-less substantially flexible upper portion that is attached to the sole. The boot is secured to the wearer's foot by laces or buckles. The boot is further secured to the wearer's mid-foot area by semi-rigid securing ears closed by a lever actuated ribbed nylon strap. The sole is comprised of rigid plastic and the heel and toe portions of the sole may conform to the requirements of ISO 5355 for ski boots. The ski boot has a plastic cuff that surrounds the upper portion of the ski boot that follows the movement of the lower leg and provides lateral support to the ankle while introducing minimal or no restriction to the fore and aft flexion of the ankle.

12 Claims, 2 Drawing Sheets

SKI BOOT

FIELD OF THE INVENTION

This invention relates to ski boots and in particular to ski boots that may be used with downhill, or alpine skis, that are equipped with safety-release bindings. The invention also relates to ski boots that are more readily compatible with certain alpine skiing techniques that date to the era before the invention of plastic ski boots and that are difficult or impossible to perform with plastic ski boots.

BACKGROUND

Before the advent of the plastic ski boot in the mid-1960's, all alpine skiers used boots constructed of leather. To provide support, the leather in the lower part of the boot was several layers thick and generally quite stiff. New leather boots required a period of break-in to soften the leather and to improve the comfort of the boots. Once broken-in, leather boots were generally quite comfortable.

In addition to serving as the attachment means between the feet and the skis, the leather boots fulfilled two very important functions. First, the leather boots provided lateral support for the foot, ankle, and lower leg to allow the skier to set an edge for controlling the skis in turns and stops, as well as allowing the skier to hold a position while skiing across slopes. The second important function served by the leather boots was to allow forward and aft flexion of the ankles in all positions between standing upright and the attitude of fully bent ankles.

New leather boots provided good lateral support but were generally painful to the front of the foot during ankle flexion. After a break-in period, the leather at the front of the boot softened and a skier's bending at the ankles became more comfortable while at the same time the boot still provided good lateral support. When the leather had broken-in to this stage, the ski boots were in a condition very acceptable to the skier.

One disadvantage of leather ski boots, however, is that the ski boots continued to soften until the leather was "broken down." At this stage, the leather became too soft, with a mushiness replacing the necessary lateral support. The excellent ankle flexion characteristics actually improved during this process, but the lateral support became progressively reduced until the ski boots become unusable. As a result, skiers had to periodically replace their leather ski boots, and it was not unusual for athletic skiers to replace their ski boots annually.

The required frequent replacement of leather ski boots was expensive and inconvenient. In the 1960's, rigid plastic ski boots, in particular the Lange plastic boot, were first made available for alpine skiing, and the rigid plastic ski boots were instantly popular. Plastic ski boots provided a superior level of lateral support, and plastic ski boots were generally more durable than leather ski boots in that they did not "break down." Plastic ski boots hold the foot, ankle, and lower leg more securely than leather ski boots but with the disadvantage that fore and aft flexion of the ankle is severely limited. Most skiers were, however, willing to trade away fore and aft ankle flexion for the greater lateral support featured by plastic ski boots, and the industry moved en-masse to the plastic boot. Within a few years, production of leather boots for alpine skiing was virtually non-existent.

The onset of the rigid plastic ski boot changed the entire skiing paradigm, in some ways for the better and in some ways for the worse. Among the characteristics of plastic alpine ski boots are (1) plastic tends not to become flexible through use, (2) plastic ski boots are more durable and wear better than leather ski boots, (3) plastic ski boots provide superior lateral support for the ankle, and (4) the rigid plastic soles retain their dimensions, which is superior for maintaining the precise settings required for safety release ski bindings. The upper portion of a plastic ski boot has a shell that encompasses the foot. The shell is hard plastic that is integral with the sole and the shell resists deflection because of its rigid construction. The foot has freedom to move only to the extent that the materials in the ski boot between the foot and the shell can compress against the rigid shell. As a result of these characteristics of plastic ski boots, it can be easier for the skier to edge, and skiing on an icy slope is easier. It can also be easier for a skier to maintain control at higher speeds using plastic boots, which can be a desirable characteristic for high speed skiing or racing. In addition, certain maneuvers that depend on good lateral support are easier to perform, for example, skiing on a single ski.

On the other hand, there are disadvantages to using plastic ski boots. Plastic ski boots restrict or entirely prevent flexion of the ankles due to the rigid plastic used, thereby restricting or eliminating the use of the ankles as pivot points, forcing the knees and hip joints to do all the absorption of the forces encountered in skiing. When plastic ski boots were introduced, skiers were required to alter their skiing technique to cope with the lack of flexion of the ankles.

Moreover, in some respects, plastic boots have too much lateral support. It is difficult, for example, not to edge, i.e., to flatten the ski against the slope, rather than dig into the slope with the edges. To flatten the skis against a slope, a wearer of plastic ski boots must usually move his knees to one side, rather than simply relax his ankles. Skiing techniques that require quick turns with the skis flattened, for example the Austrian wedel, are impossible or are accomplished with great difficulty when wearing plastic ski boots.

In contrast, leather alpine ski boots do not have a hard shell encompassing the foot and the material of the upper portion is never integral with the sole. A foot in a leather ski boot has greater freedom for small amounts of movement because of the slight deflections of the shell-less upper portion, adding comfort to the wearer. In addition, leather alpine ski boots have the following characteristics: (1) leather ski boots allow superior fore and aft ankle flexion, (2) a skier using leather boots has three pivot points (the hips, the knees, and the ankles) for absorbing the shocks and forces inherent in skiing, (3) the additional pivot at the ankles permits a skier with average ability to ski much more smoothly than is possible with plastic boots, and (4) the fact that leather ski boots have less lateral support than plastic ski boots also contributes to a skier's ability to execute a number of maneuvers in a more stylish manner.

Taken together, the superior ankle flexion and the slightly reduced lateral support of leather ski boots, as compared to plastic boots, give a skier several advantages:

a. It is easier for the skier to ski with his feet together.
b. It is easier for the skier to maintain his back in an erect position.
c. It is easier for the skier to ski with his weight over his skis, not forward or aft.
d. It is easier for the skier to release an edge and to ski with the skis flat on the snow if desired.
e. It is easier for the skier to execute such stylish techniques from the 1950's as the Austrian wedel.

While leather ski boots provide certain advantages, there are certain characteristics of leather ski boots that are disadvantageous. For example, leather ski boots have a relatively short life as compared to plastic ski boots. As discussed above, the lateral support of leather ski boots becomes reduced as the boots are flexed in normal use, and when the lateral support becomes insufficient for the purposes of the skier, the boot is deemed broken-down or worn out. Indeed, the lateral support of leather boots is always less than that of plastic boots and therefore provides less control for the skier in icy conditions and is inferior for maintaining control at high speeds.

Another disadvantage of leather ski boots is the soles of leather ski boots do not conform to the requirements of ISO 5355, *Alpine Ski-Boots—Safety Requirements and Test Methods*, the international standard that specifies the dimensions and tolerances for the soles of alpine ski boots so that they are compatible with modern ski bindings.

The technique of one's alpine skiing should be a personal matter but it is in reality dictated by the equipment that is available in the marketplace. For those who would choose to ski utilizing techniques that were prevalent prior to the advent of the plastic ski boot, it would be advantageous to choose a modern boot that included the best features from the leather ski boot era. Accordingly, it is an object of the present invention to provide alpine ski boots that feature little or no restriction to the fore and aft flexion of the ankles, while providing lateral support to the ankles, and that can meet the requirements of international standards for design to ensure compatibility with modern safety release bindings for alpine skis.

SUMMARY OF THE INVENTION

The alpine ski boot of the present invention consists of a shell-less and substantially flexible upper portion that is attached to a rigid sole comprised of plastic. The upper portion is reinforced by a semi-rigid plastic support piece that surrounds, on three sides, the lower heel region, excluding the anklebone areas. The support piece has a pivot point on each of two sides at opposite locations below the anklebone areas and may have two integral semi-rigid mid-foot region securing ears.

The boot may be secured to the wearer's foot by laces or buckles. The boot may be further secured to the wearer's foot by closure of the semi-rigid mid-foot securing ears by a suitable closure means known to the art such as a lever actuated ribbed nylon strap with an adjustable buckle or a ribbed nylon strap with a ratcheting closure system.

The ski boot has a cuff with a first end having pivoting means, such as rivets or pins, that pivots from the two opposite points on the plastic support piece. The cuff has a second end that surrounds the top region of the boot, the region of the wearer's lower leg, slightly above the anklebones area. The cuff is secured by a suitable closure means known to the art such as a lever actuated ribbed nylon strap with an adjustable buckle or a ribbed nylon strap with a ratcheting closure system. The cuff follows the movement of the lower leg and provides lateral support to the ankle, while introducing minimal or no restriction to the fore and aft flexion of the ankle.

The rigid sole has a top, a bottom, a toe end and a heel end. A heel is integral with or fixedly attached to the heel end of the bottom of the sole. The sole may have an integral fore section at the toe end on the top of the sole. The fore section, together with the toe end of the sole, can define a toe interface area of the ski boot. The sole may have an integral aft section at the heel end of the sole. The aft section, together with the heel end of the sole and with the heel, can define a heel interface area of the ski boot. Modern ski bindings require that the dimensions for the toe and heel interfaces of a ski boot meet world standards. The dimensions of the toe interface and the heel interface areas of a ski boot according to the current invention may be manufactured to conform to the requirements of ISO 5355 for ski boots.

A flexible seal of plastic, neoprene, or rubber may be fixedly attached to the top of the sole and to the lowest part of the upper portion. The seal acts to seal the region, where the upper portion joins the sole, against the entrance of environmental elements such as, for example, snow, water, and mud.

Among the advantages of certain embodiments of the ski boot are that the ski boots feature little or no restriction to the fore and aft flexion of the ankles, provide good lateral support to the ankles, and the ski boots have rigid soles with dimensions and tolerances that are compatible with modern safety release ski bindings that are designed for alpine skis. Another advantage of some embodiments of the ski boot is that the plastic support piece avoids the area of the anklebones and that the pivots for the cuff avoid the areas of the anklebones. The comfort of the boot is enhanced by avoiding the proximity of stiff materials in the area of the anklebones. Other advantages of the ski boots of the present invention will be apparent to those skilled in the art based upon the following description of the invention and associated drawings.

DETAILED DESCRIPTION OF PREFERRED EMBODIMENTS

Figure 1:
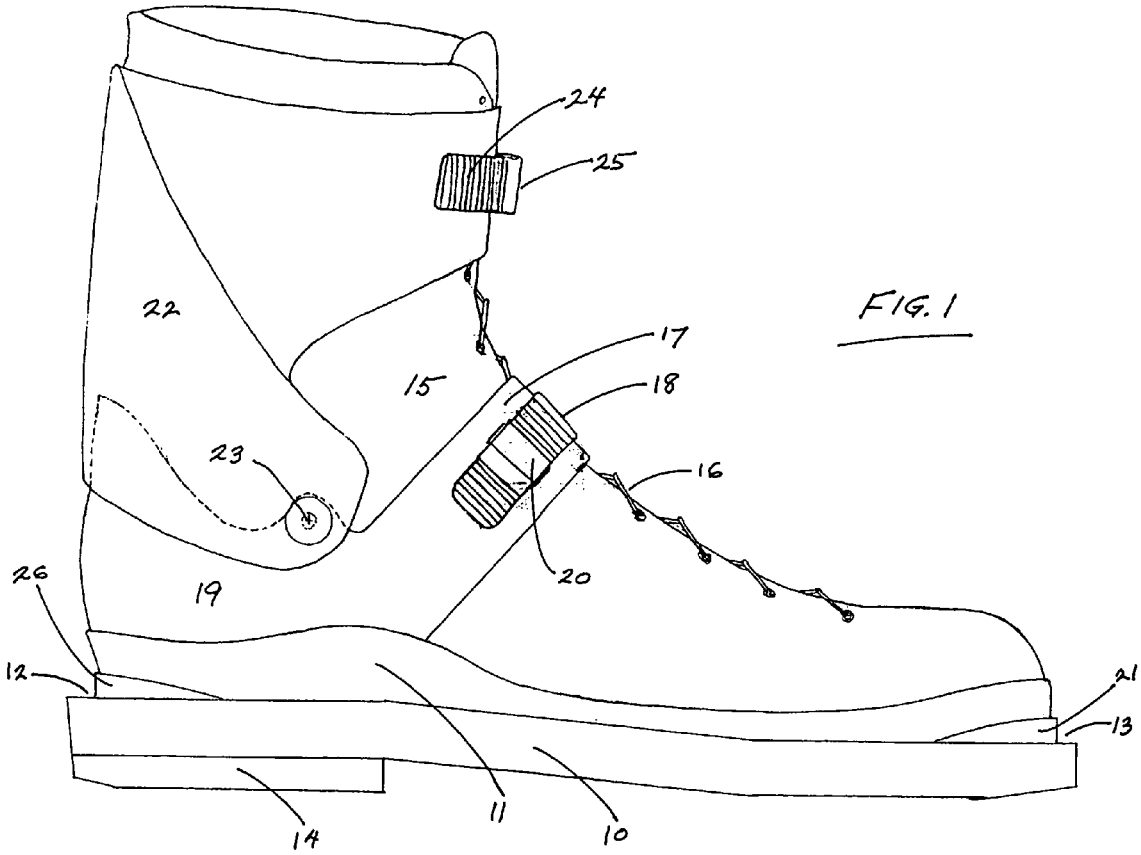
FIG. 1 is the side view of an alpine ski boot according to the present invention.
Figure 2:
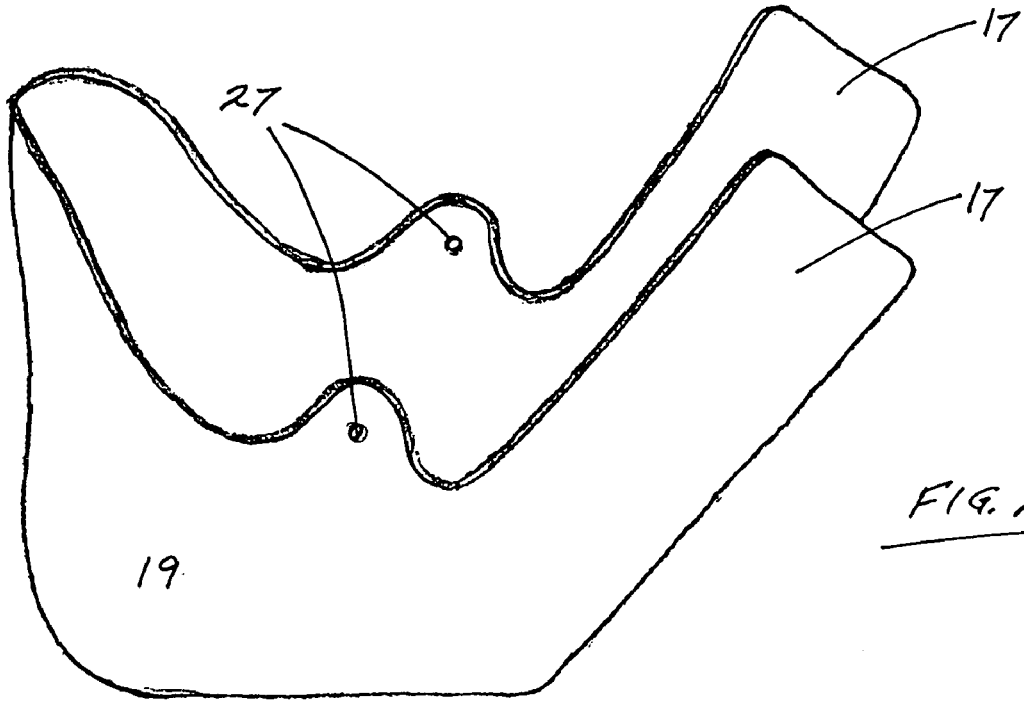
FIG. 2 is a view of a plastic support piece according to the present invention.

One embodiment of an alpine ski boot according to the present invention is shown in FIG. 1. Referring to FIG. 1, the ski boot has a shell-less and substantially flexible upper portion 15. The upper portion may be comprised of any appropriate flexible material, including for example leather, canvas, fabrics, flexible elastomers or plastics, or combinations of these materials. If desired, the upper portion may include layers or linings comprised of flexible materials such as fabrics of natural or synthetic fibers, canvas, rubber, neoprene, vinyl or flexible plastics. Referring also to FIG. 2, a semi-rigid plastic support piece 19 surrounds externally, on three sides, the back of the upper portion 15 in the heel region, excluding the anklebone areas. The support piece is preferably molded of a moderately flexible elastomer such as polypropylene or nylon. The support piece has a pivot point 27 on each of two sides at opposite locations below the anklebone areas and has two semi-rigid mid-foot region securing ears 17. The lower region of the semi-rigid support piece 19 is attached to the flexible materials of the lower heel area of the upper portion 15 by appropriate fastening means such as, for examples, gluing or stitching.

Upper portion 15, which includes the semi-rigid support piece 19, is attached to rigid sole 10 by appropriate attachment means such as, for example, gluing, stitching, nailing, or screwing. Seal 11, made of a flexible material, such as rubber, neoprene, or polyurethane, is fixedly attached to the top of the sole 10 and to the lowest part of the upper portion 15. Seal 111 is attached to both the upper portion 15 and the sole 10 by suitable attachment means such as, for example, gluing, stitching, or welding. The seal acts to seal the region, where the upper portion joins the sole, against the entrance of environmental elements such as, for example, snow, water, or mud.

Laces 16 or other closure means such as buckles secure the ski boot on the wearer's foot. The ski boot is further secured to the wearer's foot by mid-foot securing ears 17 that are integral with and part of the plastic support piece 19. The mid-foot securing ears 17 close around the upper portion 15 in the mid-foot area and are secured by a suitable closure means known to the art such as a lever actuated ribbed nylon strap 18 with an adjustable buckle 20 or a ribbed nylon strap with a ratcheting closure system.

Rigid sole 10 has a top, a bottom, a toe end, and a heel end. Sole 10 is preferably comprised of rigid plastic, such as for example glass-reinforced nylon, although, sole 10 may be a structure containing one or more plastics or other materials to impart the desired rigidity and dimensional stability. Sole 10 may be molded as a single plastic unit. Alternatively, sole 10 may be a laminate of suitable materials that include one or more plastics. If desired, sole 10 may be a laminate containing one or more layers of metal or wood, or the sole 10 may contain portions that are hollow, portions that are comprised of carbon fiber elements, or portions that are of a honeycomb construction. Heel 14 is integral with or fixedly attached to the heel end of the bottom of sole 10. The heel 14 may be fastened to the sole 10 by any appropriate fastening means, such as glue, epoxy, pins, or nails.

Sole 10 has an integral fore section 21 at the toe end on the top of the sole. Fore section 21, together with the toe end of the sole, defines the toe interface area 13 of the ski boot. Sole 10 has an integral aft section 26 at the heel end on the top of the sole. Aft section 26, together with the heel end of the sole and with the heel 14, defines the heel interface area 12 of the ski boot. The toe interface area 13 and the heel interface area 12 are used with the ski bindings to attach the ski boot to the ski. The toe interface area 13 and the heel interface area 12 are dimensioned as appropriate to be compatible with the particular bindings used on the skis. Preferably, all aspects of the boot, and in particular dimensions relating to the toe interface area 13 and the heel interface area 12, are in accordance with the specifications of ISO 5355, *Alpine Ski-Boots—Safety Requirements and Test Methods.*

A cuff 22 surrounds the lower leg region of the upper portion 15 to provide lateral support to the wearer's ankle. The cuff is preferably molded of a semi-rigid elastomer such as polypropylene or nylon. The cuff 22 is attached to the support piece 19 by means of two fasteners through the points 23 and 27 which allow the cuff to pivot against the support piece. The two fasteners are located on opposing sides of the ski boot at an elevation that is below the area of the wearer's ankle. The fasteners may be in the form of rivets or pins inserted through eyes in the cuff 22 and the support piece 19. The invention is not limited in this regard, and any appropriate fasteners that permit the cuff to pivot may be used. The cuff is open in the front portion to allow the user to put the ski boot on the foot with the cuff in an open position. The cuff closes around the top region of upper portion 15, the region that encloses the wearer's lower leg in the area above the anklebones, and is secured by a suitable closure means known to the art such as a lever actuated ribbed nylon strap 24 with an adjustable buckle 25 or a ribbed nylon strap with a ratcheting closure system.

Cuff 22 follows the movement of the wearer's lower leg and provides lateral support for the wearer's ankle while introducing minimal or no restriction to the fore or aft flexion of the ankle as a result of the ability of the cuff 22 to pivot about the fasteners 23 and as a result of the flexibility of upper portion 15.

The ski boot described herein combines leather and plastic boot technologies to assist the skier who desires to ski using techniques of the pre-plastic boot era. Among the advantages of the ski boot is improved lateral support as compared to all leather ski boots, as the plastic cuff provides better support than leather and does not break down and become mushy with use.

Another advantage of the ski boot is that the plastic cuff in combination with the flexible upper allows a small amount of lateral flex that is usable and desirable, as compared to all-plastic boots, which have virtually no lateral flex.

Yet another advantage of the ski boot described herein is that the fore and aft flexion is better than with any plastic boot. The skier gains use of the ankles as an active absorption device in addition to the joints at the hips and knees. Setting a forward angle for the ankles and then keeping that angle, as is the typical case with plastic boots, prevents the absorption abilities of the ankles. Movement at the ankles improves the absorption of the forces encountered in skiing and the less ankle restriction, the better. The combination of excellent ankle flexion and the "just right" amount of lateral support will improve the average skier's ability to ski smoothly and skillfully.

Yet another advantage of the ski boot described herein is that the ski boot is safer than a conventional leather boot because its rigid sole can dimensioned precisely so the boot can be manufactured to conform to the requirements of ISO 5355, the international standard for alpine ski boots that assures compatibility with modern safety release ski bindings.

As will be recognized by those of ordinary skill in the art based on the teachings herein, numerous changes and modifications may be made to the above-described invention without departing from its spirit or scope as defined in the appended claims. Accordingly, this detailed description of preferred embodiments is to be taken in an illustrative, as opposed to a limiting, sense.

I claim:

1. An alpine ski boot comprising:

a. a rigid sole having a top, a bottom, a toe end, and a heel end wherein the sole further comprises:

i. an integral fore section at the toe end of the top of the sole, with the fore section and the toe end of the sole defining a toe interface area for attachment to the toe portion of a safety-release type ski binding that is mounted on an alpine ski, and ii. an integral aft section at the heel end of the top of the sole, with the aft section and the heel end of the sole defining heel interface area for attachment to the heel portion of the safety-release type ski binding that is mounted on the alpine ski;

b. a heel integral with or fixedly attached to the heel end of the bottom of the sole;

c. a shell-less upper portion for containing a foot that is comprised of flexible materials, and that is partially reinforced by a plastic support piece that surrounds, on three sides, the lower heel region, excluding the anklebone areas, the support piece having a pivot point on each of two sides at opposite locations below the anklebone areas, said upper portion being fixedly attached to the top of the sole;

d. closure means to secure the ski boot to the foot; and e. a plastic cuff pivotally attached to the said support piece at the pivot points, wherein the cuff surrounds the upper portion of the ski boot at a location above the anklebone region, said cuff having a vertical opening in the front portion of the cuff to allow the ski boot to be placed on a foot and a closure means to close the cuff around the lower leg.

2. The alpine ski boot of claim 1, wherein the upper portion is comprised of leather.

3. The alpine ski boot of claim 1, wherein the upper portion is comprised of a material selected from a group consisting of leather, canvas, rubber, neoprene, vinyl, nylon, flexible plastic, fabrics of natural fibers, fabrics of synthetic fibers, and combinations thereof.

4. The alpine ski boot of claim 1, wherein the support piece is comprised of a material selected from the group consisting of polypropylene and nylon.

5. The alpine ski boot of claim 1, further comprising a flexible seal that is fixedly attached to the top of the sole and to the lower part of the upper portion.

6. The alpine ski boot of claim 1, wherein the said closure means to secure the ski boot to the foot is laces or buckles.

7. The alpine ski boot of claim 1, wherein the closure means for closing said cuff is a lever actuated ribbed nylon strap connecting to an adjustable buckle or is a ratcheting closure system.

8. The alpine ski boot of claim 1, further comprising two plastic mid-foot region securing ears and closure means for closing the securing ears at the mid-foot region.

9. The alpine ski boot of claim 8, wherein the closure means for closing the two securing ears at the mid-foot region is a lever actuated ribbed nylon strap connecting to an adjustable buckle or is a ratcheting closure system.

10. The alpine ski boot of claim 8, wherein the two plastic mid-foot region securing ears are integral with said plastic support piece.

11. The alpine ski boot of claim 1, wherein the sole is comprised of a material selected from the group consisting of rigid plastic, glass-reinforced nylon, and a laminate.

12. The alpine ski boot of claim 1, wherein the cuff is comprised of a material selected from the group consisting of polypropylene and nylon.

* * * * *